US005162609A

United States Patent [19]

Adriaenssens et al.

[11] Patent Number: 5,162,609

[45] Date of Patent: Nov. 10, 1992

[54] FIRE-RESISTANT CABLE FOR TRANSMITTING HIGH FREQUENCY SIGNALS

[75] Inventors: Luc W. Adriaenssens, Doraville; Richard D. Beggs, Buford; Harold W. Friesen; Wendell G. Nutt, both of Dunwoody, all of Ga.

[73] Assignee: AT&T Bell Laboratories, Murray Hill, N.J.

[21] Appl. No.: 739,122

[22] Filed: Jul. 31, 1991

[51] Int. Cl.[5] ..... H01B 11/02

[52] U.S. Cl. ..... 174/34; 174/113 R; 174/120 SR; 174/121 A

[58] Field of Search ..... 174/34, 36, 32, 113 R, 174/121 A, 120 SR

[56] References Cited

U.S. PATENT DOCUMENTS

| | | | |
|---|---|---|---|
| 3,006,787 | 10/1961 | Blewis et al. | 174/120 SR |
| 4,659,871 | 4/1987 | Smith et al. | 174/113 R |
| 4,697,051 | 9/1987 | Beggs | 178/63 D |
| 4,755,629 | 7/1988 | Beggs | 174/34 |
| 4,873,393 | 10/1989 | Friesen | 174/34 |
| 5,001,304 | 3/1991 | Hardin et al. | 174/121 A |
| 5,010,210 | 6/1990 | Sidi | 174/34 |
| 5,015,800 | 5/1991 | Vaupotic et al. | 174/34 |

*Primary Examiner*—Morris H. Nimmo
*Attorney, Agent, or Firm*—E. W. Somers

[57] ABSTRACT

A fire-resistant cable (20) which is suitable for the transmission of high frequency signals in a local area network includes a core which comprises a plurality of twisted pairs (22,22) of insulated conductors (24,24) and a jacket (35). Each insulated conductor of each pair includes an elongated metallic member (26) and an insulation system (28). The insulation system which is characterized by a suitable low dissipation factor includes dual layers, an outer one of which includes a flame-retardant plastic material. Also, the insulation system is characterized by a suitably low dielectric constant and by compatibility with a relatively short pair twist scheme. In one embodiment, the insulation system includes an inner layer (30) of a polyolefin plastic material and an outer layer (32) of a flame-retardant polyolefin plastic material. The jacket comprises a plastic material characterized by a suitably low dissipation factor and dielectric constant and in a preferred embodiment comprises a flame-retardant polyolefin plastic material. Preferably, the twist length of each pair does not exceed the product of about forty and the outer diameter of an insulated conductor of each pair.

17 Claims, 2 Drawing Sheets

FIRE-RESISTANT CABLE FOR TRANSMITTING HIGH FREQUENCY SIGNALS

TECHNICAL FIELD

This invention relates to a fire-resistant cable for transmitting high frequency signals. More particularly, this invention relates to a cable which has excellent fire-resistant properties and which is suitable for transmitting high frequency digital signals such as in a local area network without degradation of the signals.

BACKGROUND OF THE INVENTION

Along with the greatly increased use of computers for offices and for manufacturing facilities, there has developed a need for a cable which may be used to connect peripheral equipment to mainframe computers and to connect two or more computers into a common network. Of course, the sought-after cable desirably should provide substantially error-free transmission at relatively high rates.

A number of factors must be considered to arrive at a cable design which is readily marketable for such uses. The jacket of the sought-after cable should exhibit low friction to enhance the pulling of the cable into ducts or over supports. Also, the cable should be strong, flexible and crush-resistant, and it should be conveniently packaged and not unduly weighty. Because the cable may be used in occupied building spaces, fire-resistance also is important.

The sought-after data transmission cable should be low in cost. It must be capable of being installed economically and be efficient in terms of space required. It is not uncommon for installation costs of cables in buildings, which are used for interconnection, to outweigh the cable material costs. Building cable should have a relatively small cross-section inasmuch as small cables not only enhance installation but are easier to conceal, require less space in ducts and troughs and wiring closets and reduce the size of required, associated connector hardware.

Of importance to the design of local area network copper conductor cables are the speed and the distances over which data signals must be transmitted. In the past, this need has been one for interconnections operating at data speeds up to 20 kilobits per second and over a distance not exceeding about 15 feet. This need has been satisfied in the prior art with single jacket cable which may comprise a plurality of insulated metallic conductors that are connected directly between a computer, for example, and receiving means such as peripheral equipment. Fire-resistance, relatively modest costs and suitable mechanical properties have been achieved with such prior art metallic conductor cables.

In today's world, however, it becomes necessary to transmit data signals at much higher speeds over distances which may include several hundreds of feet. Currently, equipment is commercially available that can transmit 16 Mbps data signals for 300 or 400 feet. Even at these greatly increased distances and data rates, the desired transmission must be substantially error-free and at relatively high rates. Further advances in data rate/-distance capability are becoming increasingly difficult because of crosstalk between the pairs of commercially available cables.

To satisfy present, as well as future needs, the sought-after cable should be capable of suitable high frequency data transmission. High frequency herein is intended to mean 0.5 MHz or higher. This requires a tractable loss for the distance to be covered, and crosstalk performance and immunity to electromagnetic interference (EMI) that will permit substantially error-free transmission. Also, the cable must not contaminate the environment with electromagnetic interference.

In the prior art, transmission has been carried out on cables in which conductors insulated with polyvinyl chloride (PVC) have been used. It has been found that polyvinyl chloride insulation, although having acceptable flame retardant properties, results in transmission losses which are undesirably high for the transmission of high frequency signals. This may be overcome somewhat by increasing the gauge size of the metallic conductor portion of the insulated conductor, but, as should be apparent, this is not a desirable alternative.

Also, it has been customary to insulate metallic conductors by extruding a skin of polyvinyl chloride over a foamed polyethylene insulation material. This has been referred to as a foam-skin arrangement. Pairs are made by twisting together two of the insulated conductors. Such cables including one or more twisted pairs may be enclosed by an inner jacket, a metallic shield disposed over the inner jacket and an outer jacket disposed over the shield. Typically the outer jacket has been comprised of polyvinyl chloride.

The last-described prior art cable has disadvantages associated therewith. Foamed polyethylene disposed adjacent to the metallic conductor and having a cover of a solid PVC insulation material has acceptable fire-resistant properties. However, the twisting of the conductors into pairs causes the foam insulation to be crushed, resulting in the spacing between the metallic conductors being reduced with accompanying transmission losses. This problem is exacerbated when a short twist arrangement, which is particularly likely in a local area network environment, is used. See U.S. Pat. No. 4,873,393 which issued on Oct. 10, 1989 in the names of H. W. Friesen and Wendell G. Nutt. Further, it has been found that in prior art foam-skin insulation arrangements wherein PVC has been used as a skin, there have been undesirable losses at high frequency. Also, in a shielded cable in which PVC has been used as a inner jacket and in which each conductor is insulated with an inner layer of polyethylene and an outer layer of flame-retardant polyethylene, high frequency loss has been experienced. Also, of course, it is desirable to be able to eliminate the metallic shield, the forming of which requires additional materials and lower manufacturing line speeds.

What is needed and what seemingly has not been provided by the prior art is a cable which includes an insulation and jacketing system which causes the cable to be suitable for the transmission of high frequency signals at a suitably low loss. The sought-after cable also should be one which is acceptably fire-resistant so that it may be used in buildings. Materials used in the sought-after cable should be readily available and not impose an unduly high price penalty on the resulting product. Also, the insulation system must be such that it is not crushed when two of the insulated conductors are twisted together with a relatively short twist length.

SUMMARY OF THE INVENTION

The foregoing problems of the prior art have been overcome by the cable of this invention. An unshielded cable of this invention, which is suitable for transmission of high frequency signals, comprises a plurality of twisted pairs of insulated conductors each comprising an elongated metallic member and an insulation system which is characterized by a dissipation factor that is less than about 0.004. The insulation system also is characterized by an effective dielectric constant which is such that the velocity of propagation of signals at high frequencies along each pair is at least equal to the product of 0.65 and the velocity of light. The insulation system includes an inner layer which is contiguous to the elongated metallic member and an outer layer which comprises a flame-retardant plastic material. A jacket comprising a plastic material is characterized by a suitably low dissipation factor and dielectric constant, which in a preferred embodiment are less than about 0.01 and less than about 3, respectively, is disposed about the plurality of pairs of insulated conductors. In a preferred embodiment, the insulation system comprises an inner layer contiguous to the elongated metallic member which is made of a polyolefin material and an outer layer which comprises a flame-retardant polyolefin. Also, the jacket of the preferred embodiment is made of a flame-retardant polyolefin.

Desirably, the conductors of each pair are twisted together in accordance with a twist frequency scheme spacing described in the hereinbefore-mentioned U.S. Pat. No. 4,873,393, such that increments of the twist frequency spacing as between adjacent pairs are not uniform. Also the twist length of each pair does not exceed the product of about eighty and the outer diameter of an insulated conductor of each pair.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
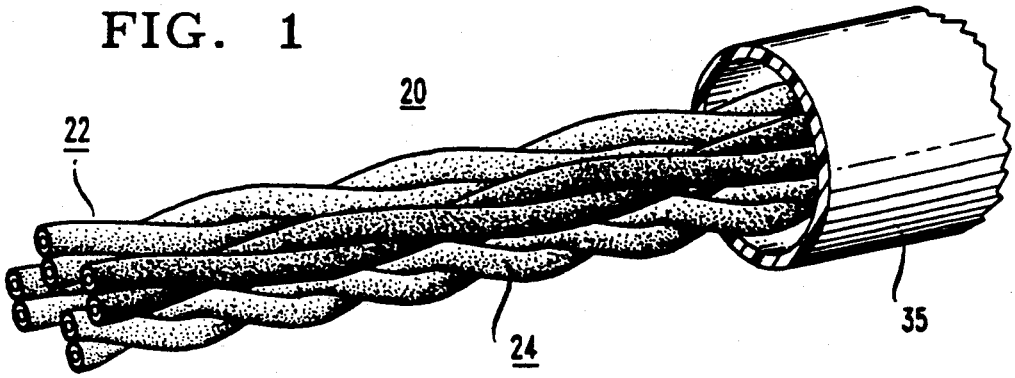
FIG. 1 is a perspective view of a cable which includes a plurality of twisted pairs of insulated metallic conductors.
Figure 2:
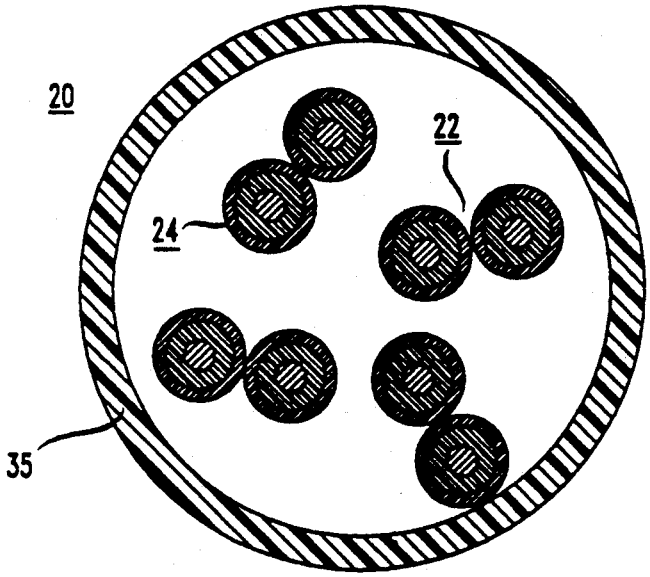
FIG. 2 is an end view of the cable of FIG. 1.

Referring now to FIGS. 1 and 2, there is shown an unshielded cable of this invention, which is designated generally by the numeral 20. The cable 20 includes a plurality of twisted pairs 22—22 of insulated metallic conductors 24—24.

Prior to a description of the structure of the insulated conductors, it becomes important to understand the causes of degradation and losses in metallic conductor cables used for communications transmission. The information capacity of a channel is given by the equation $$IC = W \log_2(1 + P/N)$$

where

W = bandwidth in Hertz;

P = average signal power; and

N = average noise power.

It is clear that the information capacity of a channel could be made infinite if (1) the bandwidth could be made infinite, (2) the average power could be made infinite, or (3) the noise could be made zero.

For the following discussion, it is assumed that signal power cannot be increased beyond present customary levels, and that the definition of noise is broadened to include not only ever-present thermal noise, but also crosstalk and electromagnetic interference (EMI).

It still is true that the information capacity of a channel is maximized if the delivered signal power is maximized and the noise (interference) is minimized. These goals equate to minimizing cable attenuation and also minimizing crosstalk and EMI.

Actually, the trend in the art is to increase channel capacity by increasing symbol (Baud) rates, thus raising the top frequency to be transmitted. This requires Emitter Coupled Logic (ECL) and decreases the power capabilities of line drive circuits. Consequently, designs having minimum attenuation at high frequencies and good resistance to interference now are needed more than ever.

The high frequency attenuation of a twisted pair used in the balanced mode is given by the following equation:

$$\alpha = 8.68[(R/2)\sqrt{C/L} + (G/2)\sqrt{L/C}] \text{ dB/100 meters}$$

where

R = high frequency (skin effect) resistance in Ohms/100 meters;

C = capacitance in Farads/100 meters;

L = inductance in Henrys/100 meters; and

G = conductance in Siemens/100 meters.

For a discussion of balanced mode, see hereinbefore identified U.S. Pat. No. 4,873,393 which is incorporated by reference hereinto. Herein it is assumed that the conductor and the conductor insulations are circular and are concentric and that a pair is formed by twisting together two insulated conductors.

For maximum channel capacity, the signal attenuation of the twisted pair should be minimized. In the above equation, the term $(R/2)\sqrt{C/L}$ typically is larger than the term, $(G/2)\sqrt{L/C}$. In order to achieve minimum attenuation, minimum values of R,C, and G are sought.

The equation also suggests that L is maximized. However, L is a dependent variable adjusted to keep the characteristic impedance constant, which thus will maintain compatibility with standard electronics. The characteristic impedance at high frequencies is given by $Z_o = \sqrt{L/C}$. Therefore the ratio, L/C, will be held constant, even as C may be varied.

The phase velocity at high frequencies is given by $$v_p = \frac{1}{\sqrt{LC}} = \frac{1}{\sqrt{\epsilon_r}} \times \text{(velocity of light)}$$

where $\epsilon_r$ is the relative dielectric constant of the insulation system.

The resistance, R, of the twisted pair is essentially the skin effect resistance, which is inversely proportional to the wire diameter. There is an added resistance, which is referred to as proximity effect, and which increases if the metallic conductor portions are very close together as they would be if the insulation system were very thin. However, the proximity resistance is much smaller than the skin effect resistance and does not vary significantly for minor adjustments in conductor spacing. Both the skin effect resistance and the proximity resistance increase proportional to the square root of frequency. Hence, the resistance of a twisted pair made with insulated copper conductors is essentially set by the copper conductor diameter, i.e. the wire gauge.

The capacitance, C, is a function of the ratio of the diameter of the insulating material or materials to the conductor diameter and of the dielectric properties of the insulating materials. Low dielectric constant insulations are desired, especially for that insulating material which is nearest to the conductor. Dielectric constants are indeed essentially constant with frequency.

The inductance, L, is determined approximately by the ratio of the insulation diameter to the conductor diameter, D/d. The inductance is essentially constant with frequency.

The conductance, G, is determined by the dissipation factors of the insulating materials. Conductance, G, is defined by the equation $G=D_f 2\pi fC$, wherein $D_f$ is the dissipation factor, f is the frequency and C is the capacitance.

Conductance increases proportional to frequency. Thus, because the resistance is proportional to the square root of frequency and the other terms are constant with frequency, the dissipation power factors of the insulating materials become increasingly important as frequency increases.

It has been determined that in order to provide a non-shielded cable which is capable of use in transmitting high frequency signals in central offices and in the local loop, each conductor of each twisted pair has a dual insulation system which is flame-retardant and which is characterized by a suitably low dissipation factor. A suitably low dissipation factor is one which does not exceed a value of about 0.004. For low loss transmission of high frequency signals, it also becomes desirable for the insulation system to be characterized by a suitably low effective dielectric constant. A suitably low effective dielectric constant for the insulation system is one such that the velocity of propagation of signals along each conductor pair at high frequencies is equal at least to the product of 0.65 and the velocity of light. A suitably low dielectric constant is one which is less than about 3. Polyvinyl chloride is characterized by a dielectric constant of 3.5 whereas that for HALAR® floropolymer is 2.6, for example.

Figure 3:
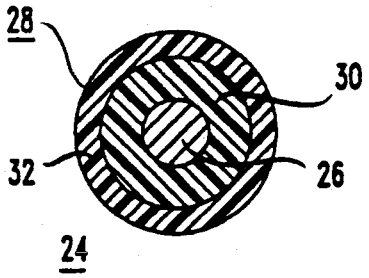
FIG. 3 is an end sectional view of one of the insulated metallic conductors of the cable of FIG. 1.

In FIG. 3 there is shown an enlarged end view in section of an insulated metallic conductor 24 having an insulation system which is flame-retardant and which is characterized by suitably low dissipation factor and dielectric constant. Each insulated metallic conductor 24 includes a metallic portion 26 and an insulation system 28. The insulation system 28 comprises a layer 30 of polyethylene which in a preferred embodiment is a linear low density polyethylene. For the polyethylene of the preferred embodiment, the dissipation factor is about 0.001 and the dielectric constant is about 2.3. The layer 30 of solid polyethylene is disposed within a layer 32 of a flame-retardant polyethylene plastic material. A suitable flame-retardant polyethylene is available from Union Carbide under the designation Unigard HP® DGDB-1430 natural thermoplastic flame-retardant material. Such material at 100 kHz and 1 MHz has a dielectric constant of 2.59 and a dissipation factor of 0.0002 in accordance with ASTM D1531 test method. For a 24 gauge copper conductor, a layer of polyethylene having an outer diameter of 0.029 inch engages the metallic conductor. The layer 32 which is disposed about the inner layer is about 0.035 inch in outer diameter. The thickness of the layer of flame-retardant polyethylene plastic material is about 0.003 inch.

It is a surprising that the skin or outer layer of a flame-retardant plastic material of each insulated conductor may be relatively thin. It would have been thought that there would be great difficulties in extruding a thin skin of such a material and that there would be breakdown through the skin during an industry used spark test. The flame-retardant polyethylene is a polyethylene which includes additives that affect adversely the ability to pass the spark test during which a spark tends to punch through the flame-retardant polyethylene.

That the insulated conductor of the cable of this invention passes an industry spark test is a surprising result. This result is achieved because of the structural arrangement of the insulation system. It appears that in the insulated conductor of the cable of this invention, the solid inner layer of polythylene resists the spark breakdown through the overlying layer of flame-retardant polyethylene. Should the inner layer of solid insulation not have suitable thickness, the insulated conductor will not pass the spark test. Or, if the insulation system comprised only a flame-retardant polyolefin material, the insulated conductor also would not pass the spark test. Of course, an insulated conductor having only a layer of solid polyolefin of sufficient thickness, e.g., about 0.006 inch, would pass the spark test, but it would not have suitable flame-retardance.

Furthermore, it has been found that the dual layer insulation system and not simply the use of dual materials is important to achieving the sought-after properties. That is, an insulation comprising a single layer of a blend of solid polyolefin and of flame-retardant polyolefin has been found not to pass the spark test.

Further, the transmission qualities of the insulated conductor are excellent notwithstanding the exhibition of excellent flame-retardance. Priorly used polyvinyl chloride was acceptable from a flame-retardance standpoint but suffered from poor transmission qualities.

The dual insulation construction of the conductor insulation system allows the use of a thin wall sufficient to obtain 100 Ohm impedance without a shield. Further, the structure of the flame-retardant, dual insulated conductor provides a dielectric robustness that is higher in dielectric strength than if only the flame-retardant polyethylene material were used.

The characterization of the twisting of the conductors of each pair 22 also is important for the cable of this invention to provide substantially error-free transmission at relatively higher rates. For cables of this invention, it has been found that the twist length for each conductor pair should not exceed the product of about eighty and the outer diameter of the insulation of one of the conductors of the pair. As should be apparent to one skilled in the art, this is a relatively short twist length. In the preferred embodiment, the twist length for each conductor pair does not exceed the product of about forty and the outer diameter of the insulation of one of the conductors of the pair.

Advantageously, the insulation system is one which is compatible with the short twist arrangement of the cable of this invention. The plastic material or materials of the insulation system are such that they are not crushed during the twisting operation.

The short pair twists of the conductor pairs of this invention reduce crosstalk (1) by reducing the distortion of the ideal helix of a pair of a given twist length when it is next to a pair with a different twist length, and (2) by reducing "pair invasion" which is the physical interlocking of a conductor of one pair with an adjacent pair thereby increasing the physical separation between pairs.

Pair invasion is an important consideration. In the prior art, seemingly it was most desirable to cause adjacent pairs to mesh together to increase the density or the number of pairs in as little an area as possible. The relatively short twist lengths minimizes the opportunity for a conductor of one pair to interlock physically with a conductor of an adjacent pair.

Figure 4:
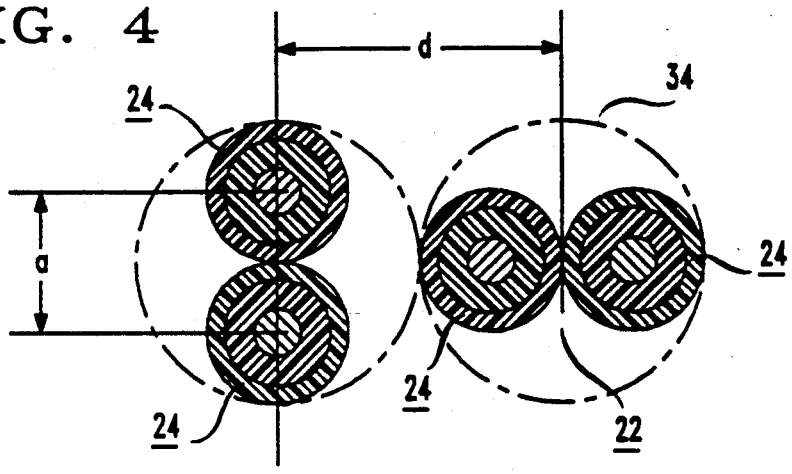
FIG. 4 is an end sectional view of two pairs of insulated conductors as they appear in a cable of this invention.

In FIG. 4 there is shown a schematic view of two pairs of insulated conductors. The conductors in FIG. 4 have already been referred to hereinbefore and are designated by the numerals 24—24. The conductors of each pair are spaced apart a distance "a" and the centers of the pairs spaced apart a distance "d" equal to twice the distance "a". The crosstalk between pairs is proportional to the quantity $a^2/d^2$. Accordingly, the greater the distance "d" between the centers of the conductor pairs, the less the crosstalk.

It is commonplace in packed cores for at least one individually insulated conductor 24 of one pair to invade the space of another pair as defined by a circumscribing circle. On the other hand, in FIG. 4 neither conductor 24 of one pair invades the circle-circumscribed space 34 of another pair. On the average, along the length of conductor pairs associated together in the cable 20, the centers of the pairs will be spaced apart the distance "d". This results in reduced crosstalk.

Conductor pairs having long twists also are found to have added losses due to impedance roughness. Roughness results when one pair invades the space of another pair. The use of twist lengths less than the product of about eighty and the outer diameter of an insulated conductor of the pair is sufficient to promote impedance smoothness thereby reducing added loss due to structural variations.

Further, it has been found that the performance of the conductors of this invention may be improved by avoiding any timing of the metallic portion of the conductor. In the prior art, it has been common to tin conductors especially those used in central offices and/or in many data transmission systems in order to enhance connections. A tin or solder coating at high frequencies causes an increase in resistance and causes an increase in attenuation due to skin effect. Not only does the elimination of a tin coating improve the transmission performance characteristics of the conductor, it also results in reduced costs.

Over the core comprising a plurality of the insulated conductor is extruded a jacket 35. The jacket 35 is comprised of a plastic material characterized by a dissipation factor less than about 0.01 and a dielectric constant less than about 3. In the preferred embodiment, the jacket also is comprised of a flame-retardant polyolefin. In the preferred embodiment, the jacket comprises flame-retardant polyethylene.

The inclusion of a jacket which is made of a flame-retardant polyolefin material overcomes problems of the prior art. In an unshielded cable, it has been found that the properties of the jacket are important to transmission performance at high frequencies. Not only is the insulation system of the conductors important to the transmission characteristics and the fire-resistance of the cable but also the jacket is an important contributor. Even though the conductor insulation system 28 results in very acceptable performance at high frequencies and fire-resistance, the jacket also must be such as not to degrade the performance and must be such as to contribute to the overall fire-resistance of the cable.

It is also important insofar as the transmission properties of the cable are concerned that the insulation system have a highly controlled pigmented or non-pigmented material contiguous to the metallic copper conductor. Of course, the solid polyolefin layer 30 of the insulation system 28 is capable of being highly controlled.

Of importance with respect to pigmented insulation are electrical properties of cable which include such conductors. It is known that the inclusion of colorant pigments in the composition of the insulation compromises the electrical properties of the insulated conductor discussed hereinbefore. Conductor insulation which has a pigment throughout affects adversely electrical properties such as capacitance. As mentioned hereinabove, achieving lower capacitance values results in higher manufacturing costs whereas higher values cause increased attenuation.

Steps may be taken to insure that any colorant material be spaced from the metallic conductor. This may be done in any of several ways. For example, a colorant material may be included in the outer layer of insulation, being blended with the flame-retardant polyolefin.

In another method of causing any colorant material to be displaced from the metallic conductor, resort is had to a so-called topcoating system in which a colorant material is sprayed, for example, onto an outer surface of the insulation. See U.S. Pat. No. 5,024,864 which issued on Jun. 18, 1991 in the names of L. L. Bleich, J. A. Roberts and S. T. Zerbs and which is incorporated by reference hereinto.

Figure 5:
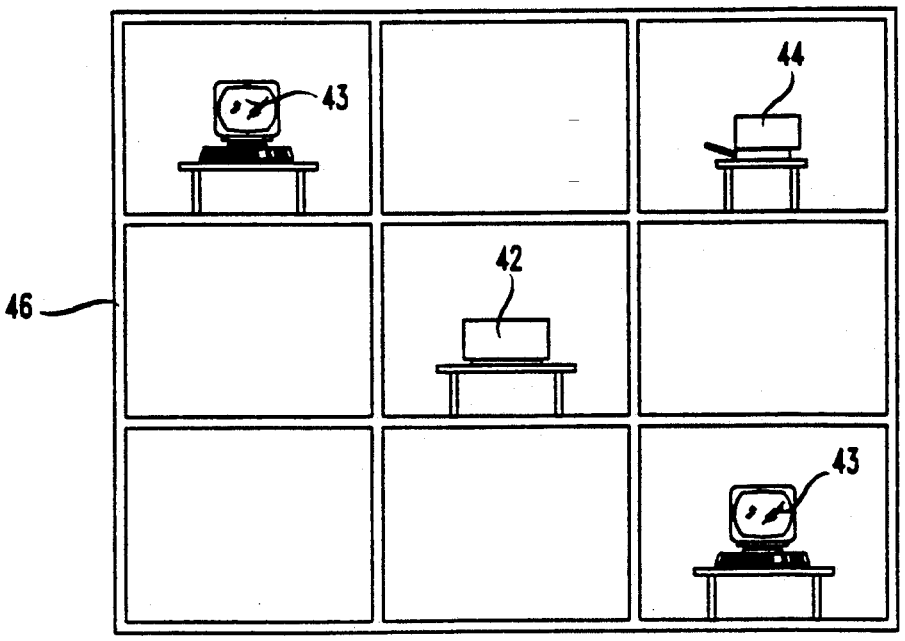
FIG. 5 is an elevational view of a building to show a mainframe computer and equipment linked by cable of this invention.

Typically, the cable 20 may be used to network one or more mainframe computers 42—42, many personal computers 43—43, and peripheral equipment 44 on the same or different floors of a building 46 (see FIG. 5). The peripheral equipment 44 may include a high speed printer, for example. Desirable, the interconnection system minimizes interference on the system to provide substantially error-free transmission and has excellent fire-resistant properties.

Deleterious effects on transmission are overcome by the cable 20 of the present invention. For example, for a 24 AWG copper conductor, 100 Ohm unshielded twisted pair, the critical frequency prior to cables of this invention appeared to be 16 MHz, whereas the frequencies of interest of cables of this invention extend to at least 100 MHz.

As a first deleterious effort, consider the internal crushing of the foam-skin insulation of the prior art as caused by the tight pair twist. The tight twists cause the conductors to move closer together which increases the capacitance and decreases the inductance. Increased capacitance and decreased inductance both increase signal attenuation. The observed effect was about 6% increased attenuation at 16 MHz and also at 64 MHz.

Next, consider the loss caused by the PVC skin of a prior art foam-skin insulation. The fields, though weak at the insulation skin, increased attenuation about 2% at 16 MHz; the increase would be about 4% at 64 MHz.

Finally, consider the loss that may be caused by the electric fields that extends into a jacket over a cable having four unshielded twisted pairs. A PVC jacket was observed to cause increased attenuation of about 2% at 16 MHz; the increase would be about 4% at 64 MHz. One fluoropolymer material that is commonly used for jacketing building cables has excellent flame-retardant properties but has an unacceptable dissipation power factor and would increase the attenuation much more.

The percentage increases caused by PVC are at room temperatures, e.g. 75 degrees F. At a slightly elevated temperature of 105 degrees F., the percentage increases would double.

The cumulative effects of these degradations at 16 MHz and room temperature are at least equal to the product of $1.06\times1.02\times1.02=1.103$. To compensate for these would require that the conductor diameters and insulation diameters all be scaled by this factor, which would increase the material weights and costs by $1.103\times1.103$ or 1.216. The cumulative effects of these degradations at 64 MHz and room temperature are at least $1.06\times1.04\times1.04=1.146$, and the effect on material weights and costs would be $1.146\times1.146=1.314$. Clearly, these are not insignificant effects.

The resistance of cable of this invention to interference also is outstanding. The pair twist design provides outstanding isolation from interference caused by signals on other pairs (crosstalk). In the preferred embodiment, it also provides a 12 dB reduction in EMI compared to standard unshielded building cables. The improvement is due to the uniform twists, both with respect to each half twist being like every other, and to the close uniform separation between the two insulated conductors of a pair.

Figure 6:
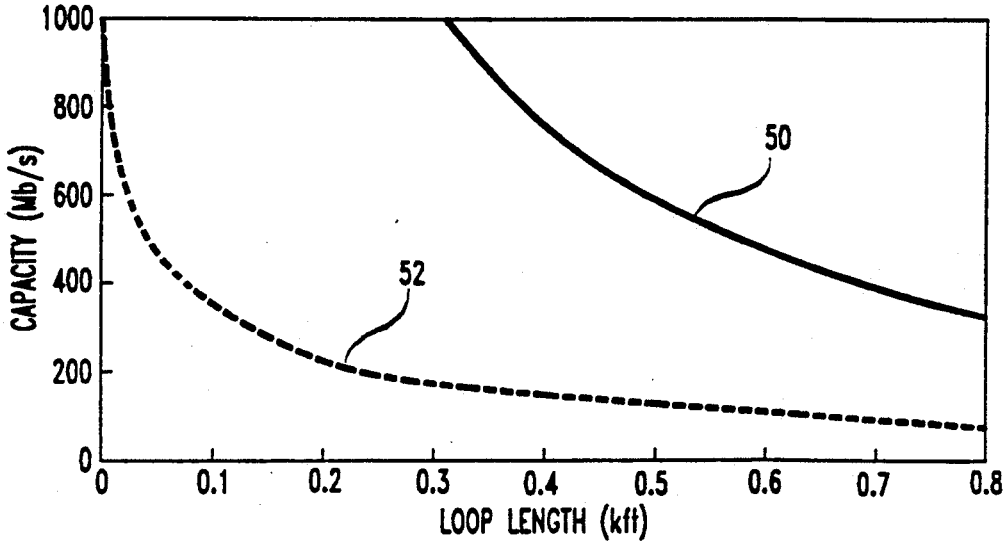
FIG. 6 is a graph which depicts the distances over which cable of this invention and of the prior art may transmit information at various rates.

In FIG. 6 there is shown a graph which depicts the theoretical loop length/capacity of the cable of this invention and for a prior art cable using optimized electronics. As can be seen, a curve 50 that depicts cable of this invention theoretically can carry 1000 Mb/second at a loop length of 300 feet, whereas a commonly used indoor wiring cable as represented by a curve 52 has a theoretical capacity of about 175 Mb/s.

It is to be understood that the above-described arrangements are simply illustrative of the invention. Other arrangements may be devised by those skilled in the art which will embody the principles of the invention and fall within the spirit and scope thereof.

We claim:

1. An unshielded, fire-resistant cable which is suitable for transmission of high frequency signals, said cable comprising:

a plurality of twisted pairs of insulated conductors, each insulated conductor comprising:

an elongated metallic member; and an insulation system which is characterized by a dissipation factor that is less than about 0.004 and by an effective dielectric constant which is such that the velocity of propagation of signals at high frequencies along each conductor pair is equal at least to the product of 0.65 and the velocity of light, said insulation system comprising an inner layer which is contiguous to said elongated metallic member and an outer layer which comprises a flame-retardant plastic material; and a jacket which is disposed about said plurality of insulated conductors and which comprises a plastic material that is characterized by a suitably low dissipation factor and dielectric constant.

2. The cable of claim 1, wherein the twist length of each pair does not exceed the product of about forty and the outer diameter of an insulated conductor of said each pair.

3. The cable of claim 2, wherein the dielectric constant of the insulation system is less than about 3.

4. The cable of claim 1, wherein said plastic material of said insulation system is such that it is compatible with a twist length which does not exceed the product of about forty and the outer diameter of an insulated conductor of each pair.

5. The cable of claim 1, wherein said jacket comprises a flame-retardant plastic material characterized by a dielectric constant less than about 3 and a dissipation factor less than about 0.01.

6. The cable of claim 1, wherein said insulation system comprises an inner layer contiguous to said elongated metallic member which is made of a polyolefin material, and an outer layer which comprises a flame-retardant polyolefin, and wherein said jacket is made of a flame-retardant polyolefin.

7. The cable of claim 6, wherein said inner layer of each insulation cover comprises polyethylene.

8. The cable of claim 6, wherein said outer layer of each insulation cover comprises flame-retardant polyethylene.

9. The cable of claim 6, wherein said jacket comprises flame-retardant polyethylene.

10. The cable of claim 6, wherein said outer layer of said insulation system has a thickness of 0.003 inch.

11. The cable of claim 6, wherein the diameter of the elongated metallic material is about 0.020 inch and the thickness of the inner layer of said insulation system is about 0.0045 inch.

12. The cable of claim 6, wherein the twist length of each pair does not exceed the product of about forty and the outer diameter of an insulated conductor of said each pair.

13. The cable of claim 6, wherein the conductors of each pair are twisted together in accordance with a twist frequency spacing such that the increments of the twist frequency spacing between adjacent pairs are non-uniform.

14. The cable of claim 6, wherein the conductor pairs are packed loosely in a core to minimize pair meshing.

15. The cable of claim 14, wherein the conductor pairs are assembled together such that each pair is disposed in a circle having a diameter equal to twice the outer diameter of an insulated conductor and such that the circle which circumscribes the cross-sectional areas of the conductors of each pair is substantially uninterrupted by the circumscribed circle of any adjacent pair.

16. The cable of claim 6, wherein each of said metallic conductors comprises untinned copper.

17. The cable of claim 6, wherein said jacket is characterized by a dissipation factor less than about 0.01 and a dielectric constant less than about 3.

* * * * *